US009966208B2

(12) United States Patent
Zhou et al.

(10) Patent No.: US 9,966,208 B2
(45) Date of Patent: May 8, 2018

(54) MANUAL OPERATION DEVICE FOR LOW VOLTAGE SWITCHING APPARATUS

(71) Applicants: SEARI ELECTRIC TECHNOLOGY CO., LTD., Shanghai (CN); ZHEJIANG CHINT ELECTRICS CO., LTD., Yueqing (CN)

(72) Inventors: Mi Zhou, Shanghai (CN); Di Shen, Shanghai (CN); Anshun You, Shanghai (CN); Degang Qu, Shanghai (CN); Zhen Li, Shanghai (CN)

(73) Assignees: SEARI ELECTRIC TECHNOLOGY CO., LTD., Shanghai (CN); ZHEJIANG CHINT ELECTRICS CO., LTD., Yueqing (CN)

( * ) Notice: Subject to any disclaimer, the term of this patent is extended or adjusted under 35 U.S.C. 154(b) by 0 days. days.

(21) Appl. No.: 14/901,573

(22) PCT Filed: Jun. 27, 2014

(86) PCT No.: PCT/CN2014/080920
§ 371 (c)(1),
(2) Date: Dec. 28, 2015

(87) PCT Pub. No.: WO2014/206330
PCT Pub. Date: Dec. 31, 2014

(65) Prior Publication Data

US 2016/0372280 A1 Dec. 22, 2016

(30) Foreign Application Priority Data

Jun. 28, 2013 (CN) ..... 2013 1 0269945

(51) Int. Cl.
*H01H 3/40* (2006.01)
*H01H 21/24* (2006.01)
(Continued)

(52) U.S. Cl.
CPC ..... *H01H 21/24* (2013.01); *H01H 3/04* (2013.01); *H01H 3/3021* (2013.01); *H01H 3/34* (2013.01); *H01H 71/52* (2013.01)

(58) Field of Classification Search
CPC ..... H01H 21/24; H01H 3/34; H01H 3/3021; H01H 3/04; H01H 71/52
(Continued)

(56) References Cited

U.S. PATENT DOCUMENTS 3,234,804 A 2/1966 Caswell
5,889,250 A 3/1999 Castonguay
(Continued)

FOREIGN PATENT DOCUMENTS

CN 87216307 U 8/1988
CN 2341266 Y 9/1999
(Continued)

OTHER PUBLICATIONS

International Search Report issued in PCT/CN2014/080920 dated Sep. 26, 2014 (2 pages).
(Continued)

*Primary Examiner* — Edwin A. Leon
*Assistant Examiner* — Lheiren Mae A Caroc
(74) *Attorney, Agent, or Firm* — Osha Liang LLP

(57) ABSTRACT

The present invention discloses a manual operation device for low voltage switching apparatus. An operating handle is provided with a fixing groove. The fixing groove is matched with a second fixing plate, the second fixing plate is placed in the fixing groove. A reset torsion spring is arranged between the second fixing plate and the fixing groove. A pawl is rotatably mounted on the second fixing plate through a fixing pin, the pawl rotates about the fixing pin. One end of a first reset spring is connected to the top end of the pawl, the other end of the first reset spring is connected to the
(Continued)

operating handle. The operating handle i mounted on a mounting shaft of an operating mechanism of the low voltage switching apparatus. A mounting plate is provided with a rotation shaft, the rotation shaft is the rotation shaft of an energy storage mechanism of the low voltage switching apparatus. The mounting shaft and the rotation shaft are not concentric. A ratchet wheel is rotatably mounted on the rotation shaft, the bottom end of the pawl is engaged with an intertooth position of the ratchet wheel. A stop detent is provided on the bottom of the mounting plate, the stop detent is rotatably mounted on the mounting plate. The top end of the stop detent is engaged with an intertooth position of the ratchet wheel. One end of a second reset spring is connected to the bottom end of the stop detent, the other end of the second reset spring is fixed on the mounting plate.

7 Claims, 2 Drawing Sheets

(51) Int. Cl.

| | |
|---|---|
| ***H01H 3/04*** | (2006.01) |
| ***H01H 71/52*** | (2006.01) |
| ***H01H 3/30*** | (2006.01) |
| ***H01H 3/34*** | (2006.01) |

(58) Field of Classification Search
USPC ..... 200/400, 501
See application file for complete search history.

(56) References Cited

U.S. PATENT DOCUMENTS

| | | | | |
|---|---|---|---|---|
| 6,072,136 | A * | 6/2000 | Wehrli, III | H01H 3/3015 200/400 |
| 6,160,234 | A | 12/2000 | Wehrli, III et al. | |
| 8,592,706 | B2 * | 11/2013 | Prince | H01H 3/3021 200/400 |
| 2012/0061219 | A1 | 3/2012 | Prince et al. | |

FOREIGN PATENT DOCUMENTS

| | | | |
|---|---|---|---|
| CN | 201051477 | Y | 4/2008 |
| CN | 201112304 | Y | 9/2008 |
| CN | 101777440 | A | 7/2010 |
| CN | 201898048 | U | 7/2011 |
| CN | 102683128 | A | 9/2012 |
| CN | 202855622 | U | 4/2013 |

OTHER PUBLICATIONS

Written Opinion of the International Searching Authority issued in PCT/CN2014/080920 dated Sep. 26, 2014 (3 pages).
Chinese Office Action in corresponding Application No. 201310269945.9 dated Nov. 4, 2015 (8 pages).
Extended European Search Report issued in corresponding European Application No. 14818806.3 dated Jan. 17, 2017 (9 pages).

* cited by examiner

MANUAL OPERATION DEVICE FOR LOW VOLTAGE SWITCHING APPARATUS

BACKGROUND OF THE INVENTION

1. Field of the Invention

The present invention relates to the field of large capacity low voltage switching apparatus, more particularly, relates to a manual operation device for large capacity low voltage switching apparatus.

2. The Related Art

In low voltage electrical appliance field, large capacity switching apparatuses, such as automatic transfer switches with a rated current over 4000 A, circuit breaker products with a rated current over 4000 A, require a large manual operating force to achieve energy storage operation and close-open operation of the switching apparatus due to their large capacity. According to the IEC standard, a required manual operating force shall be controlled under 250N. A large required manual operating force may cause difficulties in manual operations, and will be a potential risk in safety.

In existing switching apparatuses, the rotation center of a manual operation handle of an operation mechanism and the rotation center of a shaft which drives an energy storage mechanism are concentric. Such a structure is compact and convenient to realize, but requires a very large manual operating force when applied in large capacity switching apparatuses, sometimes may even cause manual operation difficulties. For automatic transfer switches with a single handle and dual energy storage mechanisms, such a structure is feasible for products with a rated current under 1600 A. However, for a product with a rated current over 4000 A, the manual operating force required by this structure is too large and will significantly influence the reliability of operations. Therefore, a new operating handle with a reasonable operating force is demanded.

SUMMARY

The present invention discloses a manual operation device with a small operating force.

According to an embodiment of the present invention, a manual operation device for low voltage switching apparatus is provided. An operating handle is provided with a fixing groove. The fixing groove is matched with a second fixing plate, the second fixing plate is placed in the fixing groove. A reset torsion spring is arranged between the second fixing plate and the fixing groove. A pawl is rotatably mounted on the second fixing plate through a fixing pin, the pawl rotates about the fixing pin. One end of a first reset spring is connected to the top end of the pawl, the other end of the first reset spring is connected to the operating handle. The operating handle is mounted on a mounting shaft of an operating mechanism of the low voltage switching apparatus. A mounting plate is provided with a rotation shaft, the rotation shaft is the rotation shaft of an energy storage mechanism of the low voltage switching apparatus. The mounting shaft and the rotation shaft are not concentric. A ratchet wheel is rotatably mounted on the rotation shaft, the bottom end of the pawl is engaged with an intertooth position of the ratchet wheel. A stop detent is provided on the bottom of the mounting plate, the stop detent is rotatably mounted on the mounting plate. The top end of the stop detent is engaged with an intertooth position of the ratchet wheel. One end of a second reset spring is connected to the bottom end of the stop detent, the other end of the second reset spring is fixed on the mounting plate.

The operating handle and the second fixing plate are provided with holes on corresponding positions, the mounting shaft passes through the holes on the operating handle and second fixing plate. The operating handle rotates about the mounting shaft, and the reset torsion spring is set on the mounting shaft.

The mounting plate is provided with a fixing component, the fixing component defines the limit position of the operation handle.

Pulling the operating handle, the operating handle rotates and drives the pawl to move, the bottom end of the pawl, which is engaged with the intertooth position of the ratchet wheel drives the ratchet wheel to rotate about the rotation shaft. The ratchet wheel rotates by one tooth and the bottom end of the pawl slides outward along an edge of the tooth of the ratchet wheel. The first reset spring pulls the pawl to rotate about the fixing pin, and the bottom end of the pawl enters into a next intertooth position of the ratchet wheel. The ratchet wheel rotates to push the stop detent to rotate and make the top end of the stop detent exit from the intertooth position of the ratchet wheel. The ratchet wheel rotates by one tooth, the stop detent is pulled by the second reset spring and the top end of the stop detent enters into a next intertooth position of the ratchet wheel.

According to the manual operation device of low voltage switching apparatus according to the present invention, the rotation centers of an operating handle and a shaft of the energy storage mechanism are not concentric. The operating handle rotates about a different shaft. Rotate the operating handle to drive a pawl mounted on the shaft, the driving torque is enlarged, so that the required manual operating force is significantly reduced. When operating a large capacity switching apparatus, using an operating handle with the structure of the present invention will be easy, comfortable, safe and reliable.

BRIEF DESCRIPTION OF THE DRAWINGS

The above and other features, natures, and advantages of the invention will be apparent by the following description of the embodiments incorporating the drawings, wherein.

DETAILED DESCRIPTION OF EMBODIMENTS

Figure 1:
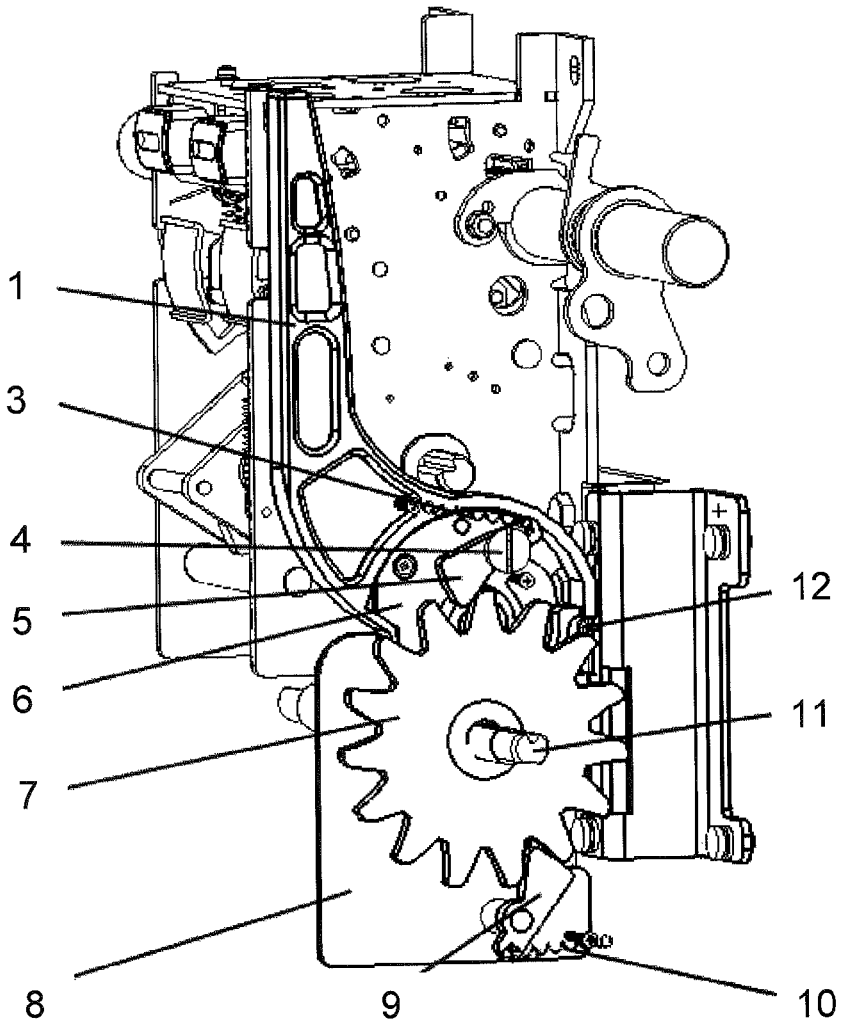
FIG. 1 illustrates the installation structure of a manual operation device for a low voltage switch apparatus according to one embodiment of the present invention.
Figure 2:
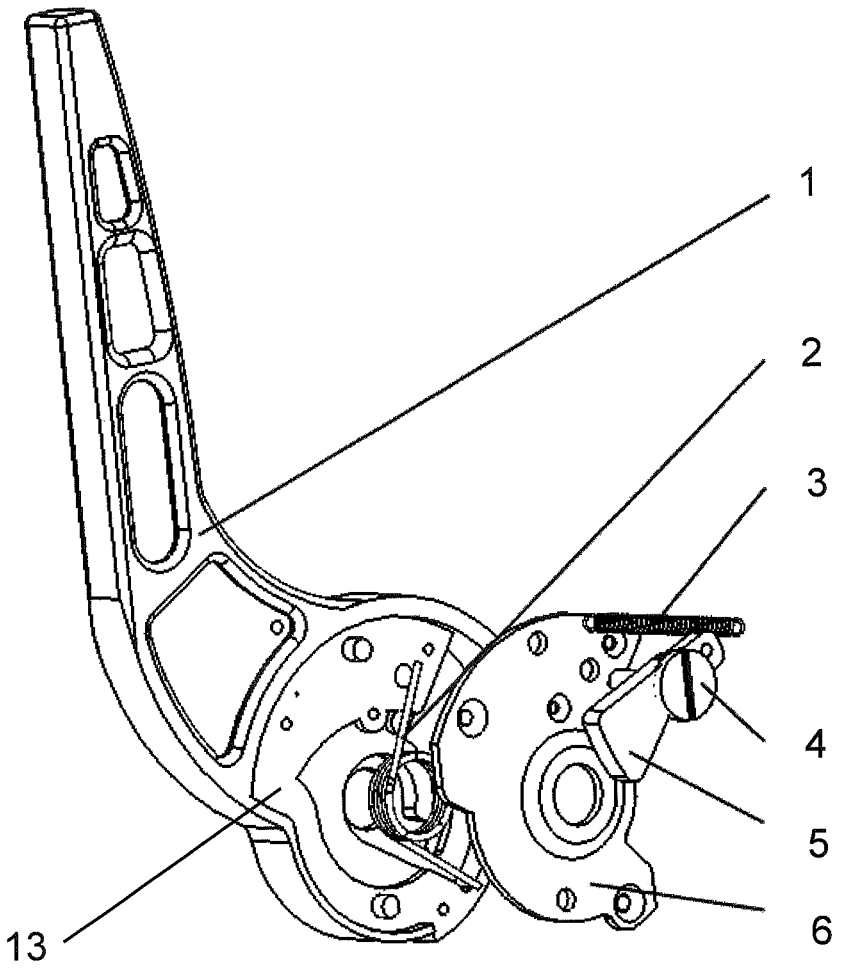
FIG. 2 illustrates the structure of the operating handle within the manual operation device for a low voltage switch apparatus according to one embodiment of the present invention.

Refer to FIG. 1 and FIG. 2, the present invention discloses a manual operation device for low voltage switching apparatus. FIG. 1 illustrates the installation structure of a manual operation device for a low voltage switch apparatus according to one embodiment of the present invention. FIG. 2 illustrates the structure of the operating handle therein. As shown in figures, an operating handle 1 is provided with a fixing groove 13, the shape and size of the fixing groove 13 is matched with a second fixing plate 6. The second fixing plate 6 is placed in the fixing groove 13, and a reset torsion spring 2 is arranged between the second fixing plate 6 and the fixing groove 13. The operating handle 1 is mounted on a mounting shaft of an operating mechanism of the low voltage switching apparatus. Refer to FIG. 2, the operating handle 1 and the second fixing plate 6 are provided with holes on corresponding positions, the mounting shaft passes through the holes on the operating handle 1 and second fixing plate 6. The operating handle 1 rotates about the mounting shaft, and the reset torsion spring 2 is set on the mounting shaft. A pawl 5 is rotatably mounted on the second fixing plate 6 through a fixing pin 4. The pawl 5 rotates about the fixing pin 4, one end of a first reset spring 3 is connected to the top end of the pawl 5, the other end of the first reset spring 3 is connected to the operating handle 1.

A mounting plate 8 is provided with a rotation shaft 11 and the rotation shaft 11 is the rotation shaft of an energy storage mechanism of the low voltage switching apparatus. The mounting shaft 6 is a different shaft with the rotation shaft 11, the mounting shaft 6 and the rotation shaft 11 are not concentric. A ratchet wheel 7 is rotatably mounted on the rotation shaft 11, the bottom end of the pawl 5 is engaged with an intertooth position of the ratchet wheel 7. The mounting plate 8 is provided with a stop detent 9 on the bottom, the stop detent is rotatably mounted on the mounting plate 8. The rotation shaft of the stop detent 9 is positioned close to the bottom of the stop detent. The top end of the stop detent 9 is engaged with an intertooth position of the ratchet wheel 7. The pawl 5 is positioned above the ratchet wheel 7 and the bottom end of the pawl 5 is engaged with the upper intertooth positions of the ratchet wheel 7. The stop detent 9 is positioned beneath the ratchet wheel 7 and the top end of the stop detent 9 is engaged with the lower intertooth positions of the ratchet wheel 7. One end of a second reset spring 10 is connected to the bottom end of the stop detent, the other end of the second reset spring 10 is fixed on the mounting plate 8. The mounting plate 8 is provided with a fixing component 12 which defines the limit position of the operation handle 1, therefor the operation handle 1 will not be blocked.

Pulling the operating handle 1, the operating handle 1 rotates and drives the pawl 5 to move. The bottom end of the pawl 5, which is engaged with the intertooth position of the ratchet wheel 7 drives the ratchet wheel 7 to rotate about the rotation shaft 11. The ratchet wheel 7 rotates by one tooth and the bottom end of the pawl 5 slides outward along an edge of the tooth of the ratchet wheel 7, which means the end bottom of the pawl 5 exits from the intertooth position. The first reset spring 3 pulls the pawl 5 to rotate about the fixing pin 4, and the bottom end of the pawl 5 enters into a next intertooth position of the ratchet wheel 7. The ratchet wheel 7 rotates to push the stop detent 9 to rotate and make the top end of the stop detent 9 exit from the intertooth position of the ratchet wheel 7. The ratchet wheel 7 rotates by one tooth, the stop detent 9 is pulled by the second reset spring 10 and the top end of the stop detent 9 enters into a next intertooth position of the ratchet wheel 7. Repeating the above process, the pawl 5 drives the ratchet wheel 7 to rotate and the stop detent 9 stops and locks the ratchet wheel 7. The ratchet wheel 7 rotates to store energy into the energy storage mechanism. More specifically, as shown in FIG. 1 and FIG. 2, rotating the operating handle 1 anti-clockwise, the pawl 5 rotates follow the operating handle 1. When an arc surface of the pawl 5 contacts with an arc surface of the ratchet wheel 7, the tangency of the arc surfaces pulls the ratchet wheel 7 to rotate and performs energy storage operation by driving the rotation shaft 11 which is used for energy storage to rotate. Meanwhile, when the ratchet wheel 7 is driven by the pawl 5 to rotate anti-clockwise, the ratchet wheel 7 pulls the stop detent 9 to rotate clockwise. When the ratchet wheel 7 rotates by one tooth, with the function of the second reset spring 10, the stop detent 9 is engaged with the ratchet wheel 7 again in a next intertooth position. Stop rotating the operating handle 1, the operating handle 1 resets under the function of the reset torsion spring 2 and prepares for the next energy storage operation.

The operating handle 1 is mounted on a shaft which is not concentric with the ratchet wheel 7. According to the embodiment illustrated by the drawings, the operation handle 1 is rotated anti-clockwise when operated, the pawl 5 rotates and drives the ratchet 7 to perform energy storage operation. Because the operating handle 1 and the ratchet wheel 7 are not concentric, the torque radius of the driving force is large, a large driving torque is generated and labor-saving effect is achieved. Under the function of the second reset spring 10, the stop detent 9 will enter and lock the ratchet wheel 7 each time the ratchet wheel 7 rotates one tooth, so as to ensure reliable positioning and prepare for the next operation.

During the operation, since the operating handle 1 and the ratchet wheel 7 are not concentric and the ratchet wheel 7 has a large radius, it is possible to operate the pawl 5 mounted on the operating handle 1 with a small operation force and obtain a large operation torque through the ratchet wheel 7 driven by the pawl 5. Therefore, a small operation force may generate a large torque to rotate the main shaft of the energy storage mechanism for storing energy. Manual operation will be easy and convenient. According to the principle described above, rotation of the operating handle will make the main shaft of the energy storage mechanism store energy, so as to meet the design requirements.

According to the manual operation device of low voltage switching apparatus according to the present invention, the rotation centers of an operating handle and a shaft of the energy storage mechanism are not concentric. The operating handle rotates about a different shaft. Rotate the operating handle to drive a pawl mounted on the shaft, the driving torque is enlarged, so that the required manual operating force is significantly reduced. When operating a large capacity switching apparatus, using an operating handle with the structure of the present invention will be easy, comfortable, safe and reliable.

The above embodiments are provided to those skilled in the art to realize or use the invention, under the condition that various modifications or changes being made by those skilled in the art without departing the spirit and principle of the invention, the above embodiments may be modified and changed variously, therefore the protection scope of the invention is not limited by the above embodiments, rather, it should conform to the maximum scope of the innovative features mentioned in the Claims.

What is claimed is:

1. A manual operation device for a low voltage switching apparatus, comprising:

an operating handle (1) provided with a fixing groove (13), the fixing groove (13) being matched with a second fixing plate (6), the second fixing plate (6) being placed in the fixing groove (13), a reset torsion spring (2) being arranged between the second fixing plate (6) and the fixing groove (13): a pawl (5) being rotatably mounted on the second fixing plate (6) through a fixing pin (4), the pawl (5) rotating about the fixing pin (4); one end of a first reset spring (3) being connected to the top end of the pawl (5), an other end of the first reset spring (3) being connected to the operating handle (1); the operating handle (1) being mounted on a mounting shaft of an operating mechanism of the low voltage switching apparatus;

a mounting plate (8) provided with a rotation shaft (11), the rotation shaft (11) being the rotation shaft of an energy storage mechanism of the low voltage switching apparatus, the mounting shaft (6) and the rotation shaft (11) being not concentric; a ratchet wheel (7) being rotatably mounted on the rotation shaft (11), a bottom end of the pawl (5) being engaged with an intertooth position of the ratchet wheel (7); a stop detent (9) being provided on a bottom of the mounting plate (8), the stop detent (9) being rotatably mounted on the mounting plate (8); a top end of the stop detent (9) being engaged with an intertooth position of the ratchet wheel (7); one end of a second reset spring (10) being connected to a bottom end of the stop decent (9), an other end of the second reset spring (10) being fixed on the mounting plate (8);

wherein when pulling the operating handle (1), the operating handle (1) rotates and drives the pawl (5) to move, the bottom end of the pawl (5), which is engaged with the intertooth position of the ratchet wheel (7) drives the ratchet wheel (7) to rotate about the rotation shaft (11), the ratchet wheel (7) rotates by one tooth and the bottom end of the pawl (5) slides outward along an edge of the tooth of the ratchet wheel (7), the first reset spring (3) pulls the pawl (5) to rotate about the fixing pin (4), and the bottom end of the pawl (5) enters into a next intertooth position of the ratchet wheel (7).

2. The manual operation device for a low voltage switching apparatus according to claim 1, wherein the operating handle (1) and the second fixing plate (6) are provided with holes on corresponding positions, the mounting shaft passes through the holes on the operating handle (1) and second fixing plate (6); the operating handle (1) rotates about the mounting shaft, and the reset torsion spring (2) is set on the. mounting shaft.

3. The manual operation device for a low voltage switching apparatus according to claim 2, wherein the mounting plate (8) is provided with a fixing component (12), the fixing component (12) defines a limit position of the operation handle (1).

4. The manual operation device for a low voltage switching apparatus according to claim 3, wherein the ratchet wheel (7) rotates to push the stop detent (9) to rotate and make the top end of the stop detent (9) exit from the intertooth position of the ratchet wheel (7), the ratchet wheel (7) rotates by one tooth, the stop detent (9) is pulled by the second reset spring (10) and the top end of the stop detent (9) enters into a next intertooth position of the ratchet wheel (7).

5. A manual operation device for a low voltage switching apparatus, comprising;

an operating handle (1) provided with a fixing groove (13), the fixing groove (13) being matched with a second fixing plate (6), the second fixing plate (6) being placed in the fixing groove (13), a reset torsion spring (2) being arranged between the second fixing plate (6) and the fixing groove (13); a pawl (5) being rotatably mounted on the second fixing plate (6) through a fixing pin (4), the pawl (5) rotating about the fixing pin (4); one end of a first reset spring (3) being connected to the top end of the pawl (5), an other end of the first reset spring (3) being connected to the operating handle (1); the operating handle (1) being mounted on a mounting shaft of an operating mechanism of the low voltage switching apparatus;

a mounting plate (8) provided with a rotation shaft (11), the rotation shaft (11) being the rotation shaft of an energy storage mechanism of the low voltage switching apparatus, the mounting shaft (6) and the rotation shaft (11) being not concentric; a ratchet wheel (7) being rotatably mounted on the rotation shaft (11), a bottom end of the pawl (5) being engaged with an intertooth position of the ratchet wheel (7); a stop detent (9) being provided on a bottom of the mounting plate (8), the stop detent (9) being rotatably mounted on the mounting plate (8); a top end of the stop detent (9) being engaged with an intertooth position of the ratchet wheel (7); one end of a second reset spring (10) being connected to a bottom end of the stop detent (9), an other end of the second reset spring (10) being fixed on the mounting plate (8);

wherein the operating handle (1) and the second fixing plate (6) are provided with holes on corresponding positions, the mounting shaft passes through the holes on the operating handle (1) and second fixing plate (6); the operating handle (1) rotates about the mounting shaft, and the reset torsion spring (2) is set on the mounting shaft;

wherein the mounting plate (8) is provided with a fixing component (12), the fixing component (12) defines the limit position of the operation handle (1).

6. The manual operation device for a low voltage switching apparatus according to claim 5, wherein when pulling the operating handle (1), the operating handle (1) rotates and drives the pawl (5) to move, the bottom end of the pawl (5), which is engaged with the intertooth position of the ratchet wheel (7) drives the ratchet wheel (7) to rotate about the rotation shaft (11), the ratchet wheel (7) rotates by one tooth and the bottom end of the pawl (5) slides outward along an edge of the tooth of the ratchet wheel (7), the first reset spring (3) pulls the pawl (5) to rotate about the fixing pin (4), and the bottom end of the pawl (5) enters into a next intertooth position of the ratchet wheel (7).

7. The manual operation device for a low voltage switching apparatus according to claim 5, wherein the ratchet wheel (7) rotates to push the stop detent (9) to rotate and make the top end of the stop detent (9) exit from the intertooth position of the ratchet wheel (7), the ratchet wheel (7) rotates by one tooth, the stop detent (9) is pulled by the second reset spring (10) and the top end of the stop detent (9) enters into a next intertooth position of the ratchet wheel (7).

* * * * *